US011385669B2

(12) United States Patent
Nome Silva et al.

(10) Patent No.: US 11,385,669 B2
(45) Date of Patent: Jul. 12, 2022

(54) LOW-IQ CURRENT MIRROR TRIMMING

(71) Applicant: TEXAS INSTRUMENTS INCORPORATED, Dallas, TX (US)

(72) Inventors: Faruk Jose Nome Silva, Sunnyvale (CA); Amanda Tomlinson, Santa Clara, CA (US); Aldrin Paynter, Santa Clara, CA (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 16 days.

(21) Appl. No.: 17/138,731

(22) Filed: Dec. 30, 2020

(65) Prior Publication Data

US 2021/0271280 A1 Sep. 2, 2021

Related U.S. Application Data

(60) Provisional application No. 62/983,847, filed on Mar. 2, 2020.

(51) Int. Cl.
*G05F 3/26* (2006.01)
*G05F 3/30* (2006.01)

(52) U.S. Cl.
CPC ..... *G05F 3/262* (2013.01); *G05F 3/30* (2013.01)

(58) Field of Classification Search
CPC ..... G05F 3/262; G05F 3/30
See application file for complete search history.

(56) References Cited

U.S. PATENT DOCUMENTS 5,424,628 A * 6/1995 Nguyen ..... G05F 3/267 323/907
7,573,323 B2 8/2009 Moholt et al.
8,531,236 B2 * 9/2013 Lechner ..... G05F 3/262 327/543
9,961,729 B1 5/2018 Narayanan et al.
2008/0061864 A1 * 3/2008 Oberhuber ..... G05F 3/30 327/512

(Continued)

OTHER PUBLICATIONS

Bajoria, et al.: "Precision Current Mirror"; Thesis submitted in Jul. 2010; pp. 1-100.

(Continued)

*Primary Examiner* — Jue Zhang
(74) *Attorney, Agent, or Firm* — Michael A. Davis, Jr.; Charles A. Brill; Frank D. Cimino

(57) ABSTRACT

A trimmable and switchable current mirror can be used in a bandgap voltage reference to calibrate the voltage reference without requiring access to measurement of the quiescent current $I_Q$ of the voltage reference. Trimmable transistors within the current mirror are alternately selectable as the diode-connected transistor via a mirror switch signal. A bandgap voltage difference is computed for two bandgap voltage values measured for alternate switched configurations of the current mirror. A set of such differences is computed and stored for different trim configurations of the mirror transistors, and the trim configuration corresponding to the lowest absolute value bandgap voltage difference can be selected as the optimal trim configuration. Following mirror transistor trim adjustment, a bandgap resistor trim can be adjusted to further calibrate the bandgap voltage reference.

20 Claims, 6 Drawing Sheets

(56) References Cited

U.S. PATENT DOCUMENTS

| | | | | |
|---|---|---|---|---|
| 2009/0289697 | A1* | 11/2009 | Gabillard | G05F 3/30 327/539 |
| 2014/0203794 | A1* | 7/2014 | Pietri | G05F 3/02 323/313 |
| 2019/0131863 | A1* | 5/2019 | El Markhi | H02M 3/156 |
| 2020/0076442 | A1* | 3/2020 | Shafeeu | H03M 1/682 |

OTHER PUBLICATIONS

Brokaw: How to Make a Bandgap Voltage Reference in One Easy Lesson:; found on the internet on Mar. 1, 2021 at: https://www.renesas.com/us/en/document/whp/how-make-bandgap-voltage-reference-one-easy-lesson-paul-brokaw; pp. 1-60.

* cited by examiner

LOW-IQ CURRENT MIRROR TRIMMING

CROSS-REFERENCE TO RELATED APPLICATION

This application claims priority to U.S. provisional patent application No. 62/983,847, filed 2 Mar. 2020, which is hereby incorporated by reference.

TECHNICAL FIELD

This description relates generally to electronic circuits, and more particularly to trimming for low-$I_Q$ current mirrors.

BACKGROUND

Analog circuits can be adjusted, or "trimmed," after fabrication. One such analog circuit that can be found in integrated circuits is a bandgap voltage reference, also referred to as a bandgap reference. Voltage references can be used in analog integrated circuits to provide, to one or more circuit loads, voltage values that are stable across varying temperature, the circuit loads being, for example, components requiring power supplied by a steady voltage. A voltage reference can include a current mirror, an analog circuit that can be used for copying a reference current that flows through one branch of the mirror as an output current that flows on another branch of the mirror. A first diode-connected transistor in a current mirror can act as an input device and a second transistor can act as an output device. The same gate-source voltage across the two mirror transistors ensures equal current flow through both of the mirror transistors. The reference current can be adjusted, for example, by trimming a variable resistor through which the reference current flows. Current mirror errors due to transistor mismatch deteriorate the performance of precision analog circuits, including bandgap voltage references in which the mirrors are used.

The quiescent current $I_Q$ of a voltage reference, sometimes termed the "no-load current," designates the current drawn by an unloaded voltage reference. A voltage reference having a lower $I_Q$ consumes lower current, and therefore lower power, on average, making low-$I_Q$ current mirrors (e.g., those having an $I_Q$ of less than 500 nA, e.g., about 200 nA) useful in voltage sources used in battery-powered devices and other systems in which low power consumption is desirable.

SUMMARY

An example trimmable and switchable current mirror includes a first terminal configured to provide a reference current to be mirrored and a second terminal configured to provide an output current that mirrors the reference current. The current mirror further includes a first trimmable transistor and a second trimmable transistor each having a respective gate, source, and drain and coupled to each other at their respective gates, and to a positive voltage terminal at their respective sources. The current mirror further includes a first switch coupled at a first end to the drain of the first trimmable transistor and at a second end to the gate of the first trimmable transistor. The first switch is controlled by a mirror switch signal. The current mirror further includes a second switch coupled at a first end to the drain of the second trimmable transistor and at a second end to the gate of the second trimmable transistor. The second switch is controlled by the logical complement of the mirror switch signal. The current mirror further includes a first multiplexer coupled at an input terminal to the drain of the first trimmable transistor, at a first selectable output terminal to the second terminal of the current mirror, and at a second selectable output terminal to the first terminal of the current mirror. The selection between the first and second selectable output terminals of the first multiplexer is controlled by the mirror switch signal. The current mirror further includes a second multiplexer coupled at an input terminal to the drain of the second trimmable transistor, at a first selectable output terminal to the second terminal of the current mirror, and at a second selectable output terminal to the first terminal of the current mirror. The selection between the first and second selectable output terminals of the second multiplexer is controlled by the logical complement of the mirror switch signal. The current mirror further includes a mirror switch input configured to provide the mirror switch signal. The current mirror further includes a mirror trim input configured to provide mirror trim signals to the first and second trimmable transistors.

In an example method of trimming a current mirror in a bandgap voltage reference, an initial mirror trim code is selected. This mirror trim code adjusts the effective width-to-length ratios of first and second transistors in the current mirror. The first and second transistors are alternately selectable the diode-connected transistor within the current mirror via a mirror switch command. For different mirror trim codes, beginning with the initial mirror trim code, a number of bandgap voltage differences are stored by iteratively measuring a first bandgap voltage with the mirror switch command set to a first setting, measuring a second bandgap voltage with the mirror switch command set to a second setting, and computing and storing a difference between the second bandgap voltage and the first bandgap voltage. The mirror trim code corresponding to the lowest absolute value difference from among the stored bandgap voltage differences is selected and the current mirror is trimmed with the selected mirror trim code.

Another example includes a bandgap voltage reference that includes a trimmable and switchable current mirror having a first terminal configured to provide a reference current to be mirrored and a second terminal configured to provide an output current that mirrors the reference current. The current mirror further includes first and second transistors that are trimmable via a mirror trim signal and are alternately selectably diode-connected via a mirror switch signal. The voltage reference further includes a first bipolar junction transistor (BJT) and a second BJT each having a respective base, emitter, and collector and coupled to each other at their respective bases, the collector of the second BJT being coupled to the second terminal of the current mirror and the collector of the first BJT being coupled to the first terminal of the current mirror, the first BJT being larger in area than the second BJT. The voltage reference further includes a first resistor coupled at a first end to the emitter of the first BJT and at a second end to the emitter of the second BJT. The voltage reference further includes a trimmable second resistor coupled at a first end to the emitter of the second BJT and at a second end to a low voltage terminal. The voltage reference further includes a bandgap control feedback loop coupled at a first end to the bases of the second and first BJTs and at a second end to the second terminal of the current mirror.

DETAILED DESCRIPTION

Devices and methods of this description provide trimming of current mirrors with accuracy in the range beyond the capability of standard automated test equipment (ATE) resources. As an example, in a bandgap reference circuit with 200 nA flowing in a Brokaw core, a current mirror in the bandgap reference may need to be trimmed to 100 nA±1.5% over mismatch, meaning to a precision of 1.5 nA. However, 1.5 nA is below a typical tester resource (e.g., current meter) precision, which may, for example, be about 8 nA minimum.

Figure 1:
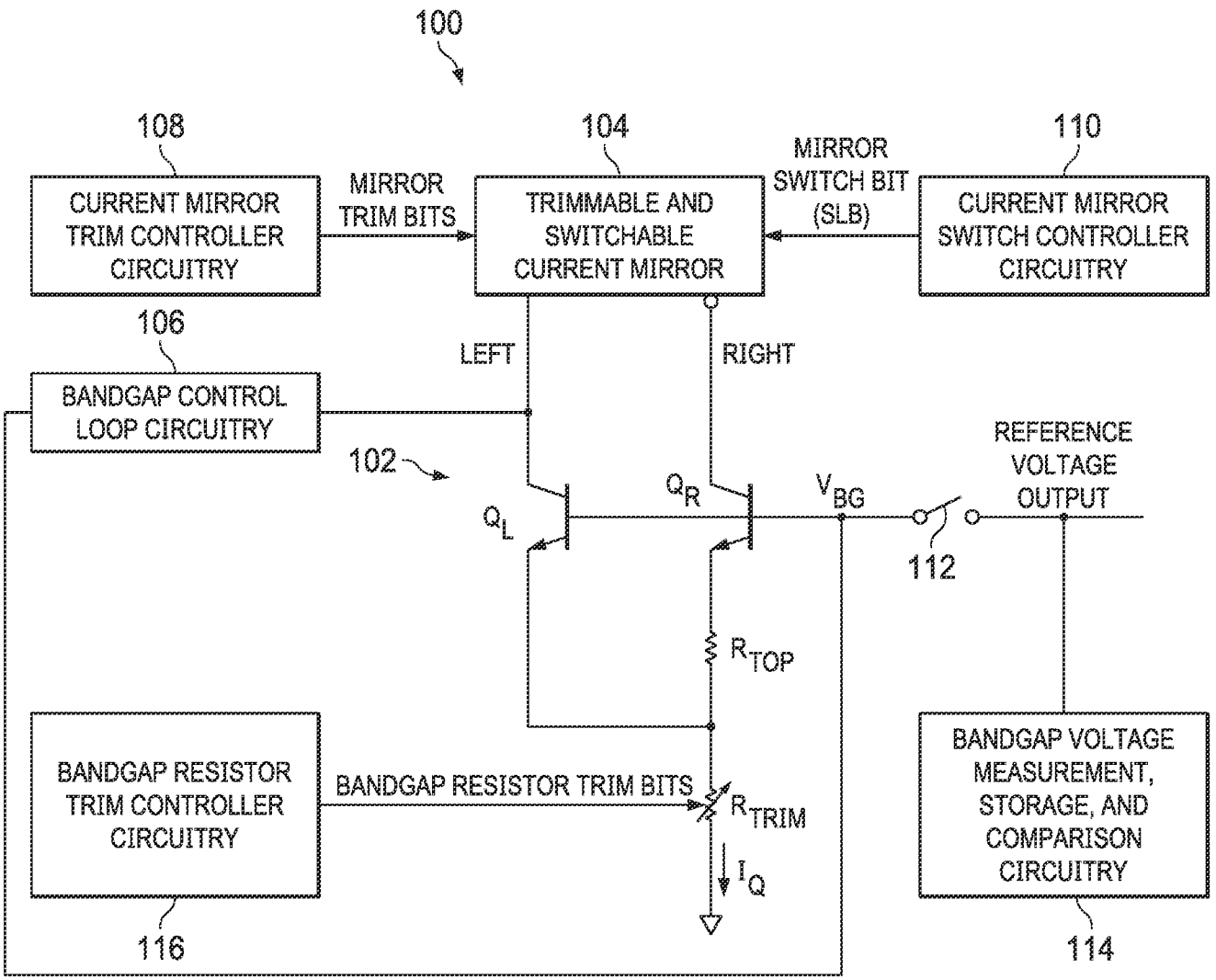
FIG. 1 is a block diagram of an example bandgap reference with a trimmable and switchable current mirror.

FIG. 1 is a block diagram of an example bandgap reference 100 configured with circuitry capable of trimming a current mirror in the bandgap reference to within precisions not measurable by available ATE resources, or otherwise when it is undesirable to directly measure quiescent current $I_Q$. A first (or "right") bipolar junction transistor (BJT) $Q_R$ and a second (or "left") BJT $Q_L$ form a pair 102 that can be configured, for example, as part of a Brokaw cell. In the example of FIG. 1, the mirror to be optimized 104 for matching is inside a bandgap reference, but in other examples, other circuits can replace the bandgap reference to optimize current mirror 104. In this way, the bandgap reference can be seen as the mirror testing circuit. In bandgap reference 100, the reference voltage $V_{BG}$ is created by resistor $R_{TRIM}$ and BJTs $Q_L$ and $Q_R$. BJT $Q_R$ is larger in area than BJT $Q_L$ (e.g., between 8 and 10 times larger), and therefore the voltage between the base and the emitter of BJT $Q_R$ is smaller than the voltage between the base and the emitter of BJT $Q_L$, because the two BJTs run the same current, as guaranteed by the mirror connection on the top, provided by trimmable and switchable current mirror 104. In operation, bandgap reference 100 produces a reference voltage $V_{BG}$ that is stable across variations in temperature. Most of the error of the voltage reference 100 derives from device mismatch in the main current mirror 104. Quiescent current $I_Q$ may be, for example, 100 nA.

Trimmable and switchable current mirror 104 can be adjusted to correct for mismatch. Adjustability of the trim mirror gain is provided via mirror trim bits supplied by current mirror trim controller circuitry 108. The mirror trim bits may, for example, provide a trim resolution of less than half a nanoamp (500 pA) for the least significant trim bit. Current mirror switch controller circuitry 110 supplies a signal or signals that effectively function to swap the branches in the trim mirror. A closed loop around the BJT pair 102, including bandgap control loop circuitry 106, can be used to minimize current sensing errors and to gain the error signal. Control loop circuitry 106 can include, for example, an operational amplifier (OPAMP) in examples where the bandgap voltage reference is a standard Brokaw cell. In other examples, the voltage reference can be a shunt, in which additional circuitry is provided to pull the bandgap high, and a control signal is provided to pull the bandgap low. In the simplest example, control loop circuitry 106 can be a short. The purpose of control loop circuitry 106 for the bandgap voltage reference is to compare the current on the two BJTs $Q_L$, $Q_R$. The mirror 104 provides the comparison point. The current on a right transistor of the mirror (not shown in FIG. 1) is mirrored down via a left transistor of the mirror (not shown in FIG. 1) and compared to the current on the left BJT $Q_L$. The control loop maintains equality of the two currents to regulate the bandgap voltage reference.

Trimmable and switchable current mirror 104 is flipped via a mirror switch command and can be trimmed (for example, by sweeping through mirror trim bit codes) until the effective mismatch of the current mirror is eliminated or minimized (for example, by selecting the mirror trim bit code that shows the least amount of difference in bandgap voltage $V_{BG}$ when flipping via the mirror switch command). Bandgap voltage connection switch 112 can be closed to provide the reference voltage $V_{BG}$ to an outside load (not shown) at a reference voltage output and/or to provide the reference voltage $V_{BG}$ to bandgap voltage measurement, storage, and comparison circuitry 114. After the mismatch of the mirror is eliminated or minimized, bandgap resistor trim controller circuitry 116 can supply a signal (e.g., in the form of resistor trim bits) to adjust the resistance value of adjustable resistor $R_{TRIM}$ in order to produce a reference voltage $V_{BG}$. The illustrated elements 102-116 can be implemented in a single integrated circuit or in multiple integrated circuits.

Figure 2:
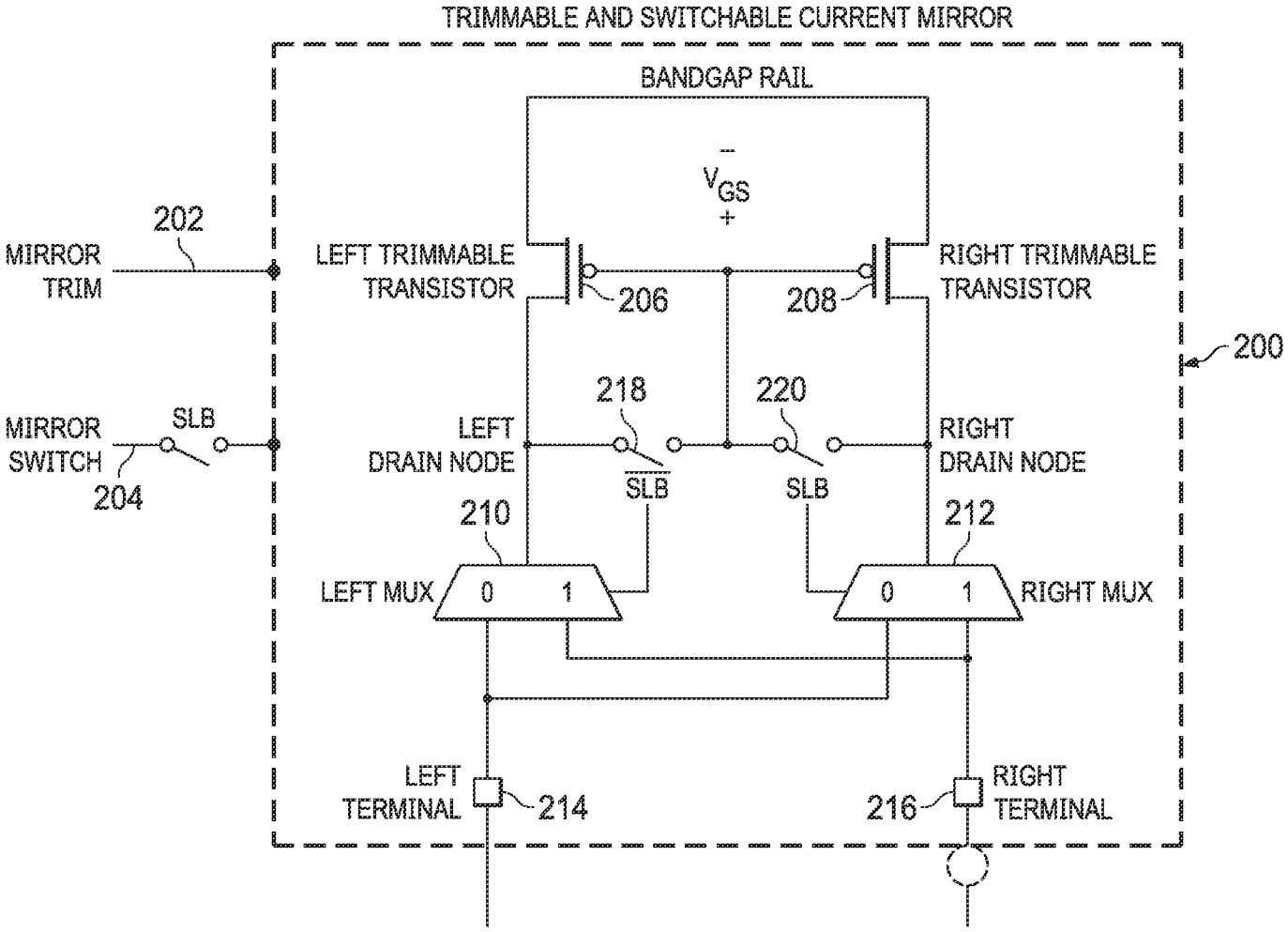
FIG. 2 is a block diagram of an example trimmable and switchable current mirror.

The block diagram of FIG. 2 shows an example trimmable and switchable current mirror 200 that can be used to implement trim mirror 104 in voltage reference 100 of FIG. 1. Current flowing through the right terminal 216 is the reference current that the mirror 200 works to copy as current flowing through the left terminal 214. First (or "right") trimmable transistor 208 and second (or "left") trimmable transistor 206 can have their effective width-to-length ratios (W/L) modified via control signals supplied by mirror trim input 202. These mirror trim signals can have the form of multi-bit trim codes and can be supplied, for example, by digital controller circuitry such as current mirror trim controller circuitry 108 in FIG. 1. The trimmable transistors 206, 208 can have any composition that affects the drain current with respect to the gate-source voltage $V_{GS}$. The trimmable transistor can, for example, include source degeneration resistors. In some examples, transistors 206, 208 can be configured in a 1:1 ratio when the transistors 206, 208 are provided identical trim input signals. In other examples, the transistors 206, 208 can be configured in ratios other than 1:1. For example, current mirror 200 will still function in substantially the same way as if the transistors 206, 208 are in a 1:1 ratio, if the current through the right terminal 216 is ten times smaller than the current through the left terminal 214, and the transistors 206, 208 are scaled 10:1 correspondingly.

Right terminal 216 is in electrical contact with a mirror-connected transistor, which is either the left transistor 206 or the right transistor 208, depending on the selection made by multiplexers 210, 212 and switches 218, 220. A mirror switch input 204 is illustrated in FIG. 2 as a switch, but can be a single-bit input that can be either high (logical "1") or low (logical "0"). This input 204 provides a "switch left bit" (SLB) that, when high, connects the gate and drain of the right trimmable transistor 208 to the right terminal 216 via the right multiplexer 212, and connects the drain (but not the gate) of the left trimmable transistor 206 to the left terminal 214 via the left multiplexer 210. When SLB is low, its logical complement is high, connecting the gate and drain of the left trimmable transistor 206 to the right terminal 216 via the left multiplexer 210, and connecting the drain (but not the gate) of the right trimmable transistor 208 to the left terminal 214 via the right multiplexer 212. Thus, mirror switch signal SLB controls which trimmable transistor 206, 208 is connected to the right terminal 216, with the gate of that diode-connected transistor always connected to the right terminal. The multiplexers 210, 212 function as single-pole, double-throw (SPDT) switches and can be implemented as controllable SPDTs.

Figure 3:
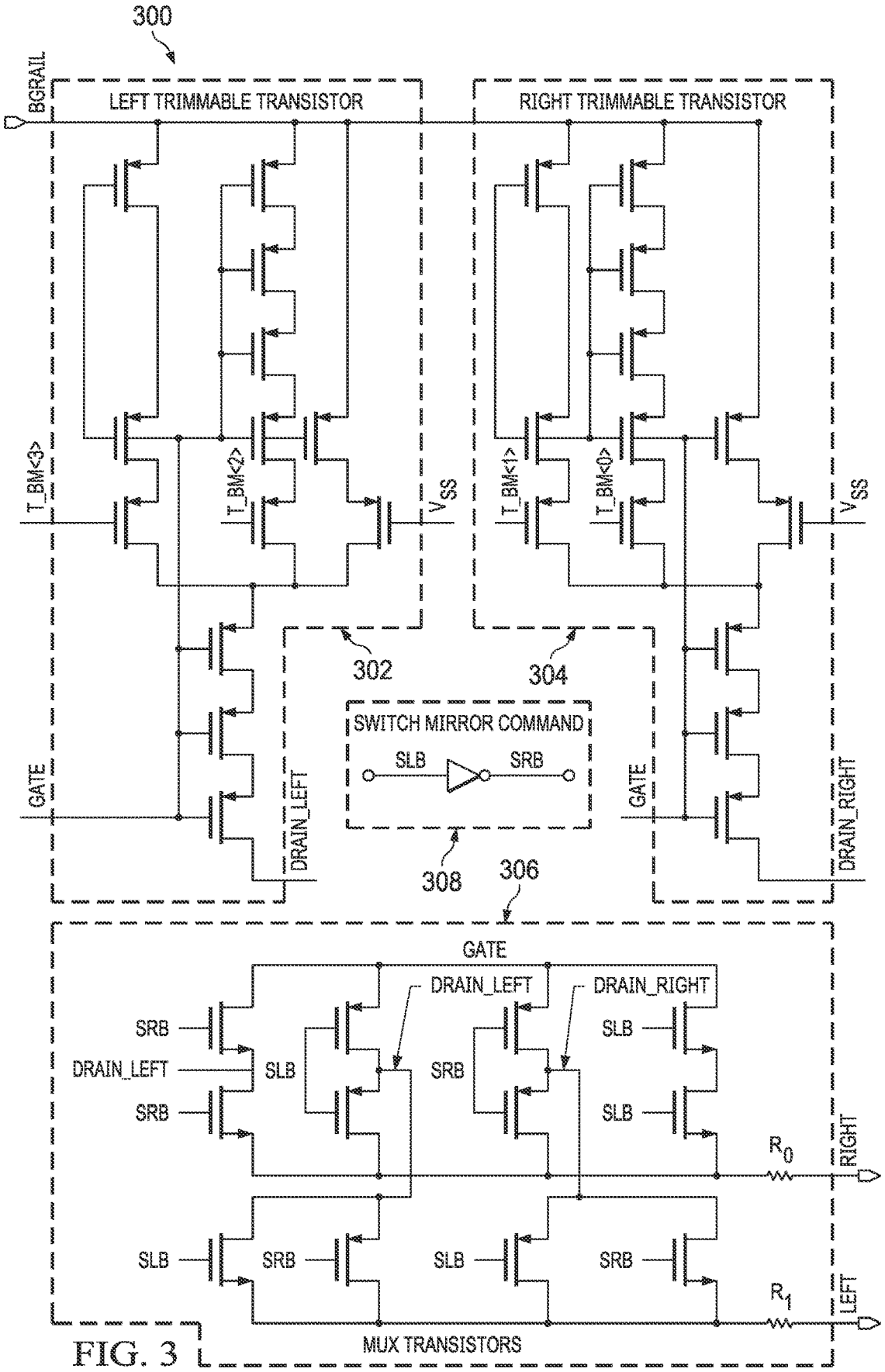
FIG. 3 is a circuit diagram of example trimmable and switchable current mirror circuitry.

The circuit diagram of FIG. 3 shows an example trimmable and switchable current mirror circuitry 300 that can be used, for example, to implement current mirror 200 in FIG. 2 and current mirror 104 in FIG. 1. The right terminal RIGHT is in electrical contact with a diode-connected transistor, which is either left trimmable transistor 302, which can correspond to left trimmable transistor 206 of FIG. 2, or right trimmable transistor 304, which can correspond to right trimmable transistor 208 of FIG. 2, depending on the value of mirror switch signal SLB and its logical complement, termed SRB in FIG. 3, which can be generated for example, by inverting buffer 308. This SLB signal can be provided, for example, by the mirror switch 204 of FIG. 2 or by the current mirror switch controller circuitry 110 of FIG. 1. Multiplexer transistors 306, which collectively can correspond to multiplexers 210, 212 of FIG. 2, assist in the performance of the selection of which of the two transistors 302, 304 is diode-connected. As shown in FIG. 3, each transistor 302, 304 can be composed of a number of field effect transistors (FETs). The trimmability of the transistors 302, 304 is provided by a mirror trim code which, in the illustrated example, is a four-bit trim code consisting of mirror trim bits T_BM<3>, T_BM<2>, T_BM<1>, T_BM<0>. In other examples, not illustrated, the trim code can have a greater number of bits for higher trim resolution. This trim code can correspond to the mirror trim signal 202 of FIG. 2 and can be provided, for example, by the current mirror trim controller circuitry 108 of FIG. 1.

Bandgap rail BGRAIL is shown at the top of FIG. 3. All the gates of the individual FETs in trimmable transistors 302, 304 are connected to the same voltage value, GATE, such that trimmable transistors 302, 304 have the same gate-source voltage GATE-BGRAIL.

Ideally, left and right current mirror transistors 206, 208 in FIG. 2 would be completely matched and the mirror would not need to be trimmed. In practical implementation, however, there is some mismatch between transistors 206, 208 that can be mitigated by trimming the trimmable transistors 206, 208 in the trimmable and switchable current mirror 104 in FIG. 1. Changing the third and second mirror trim bits T_BM<3> and T_BM<2> in FIG. 3 effectively adjusts the W/L ratio of left transistor 302, adjusting the trim of one side of the current mirror 104. Changing the first and zeroth mirror trim bits T_BM<1>, T_BM<0> effectively adjusts the W/L ratio of right transistor 304, adjusting the mirror trim of the other side of the current mirror 104. By adjusting the mirror trim bits, the mirror ratio of mirror 104 can be adjusted, for example, to within ±1%.

Figure 4:
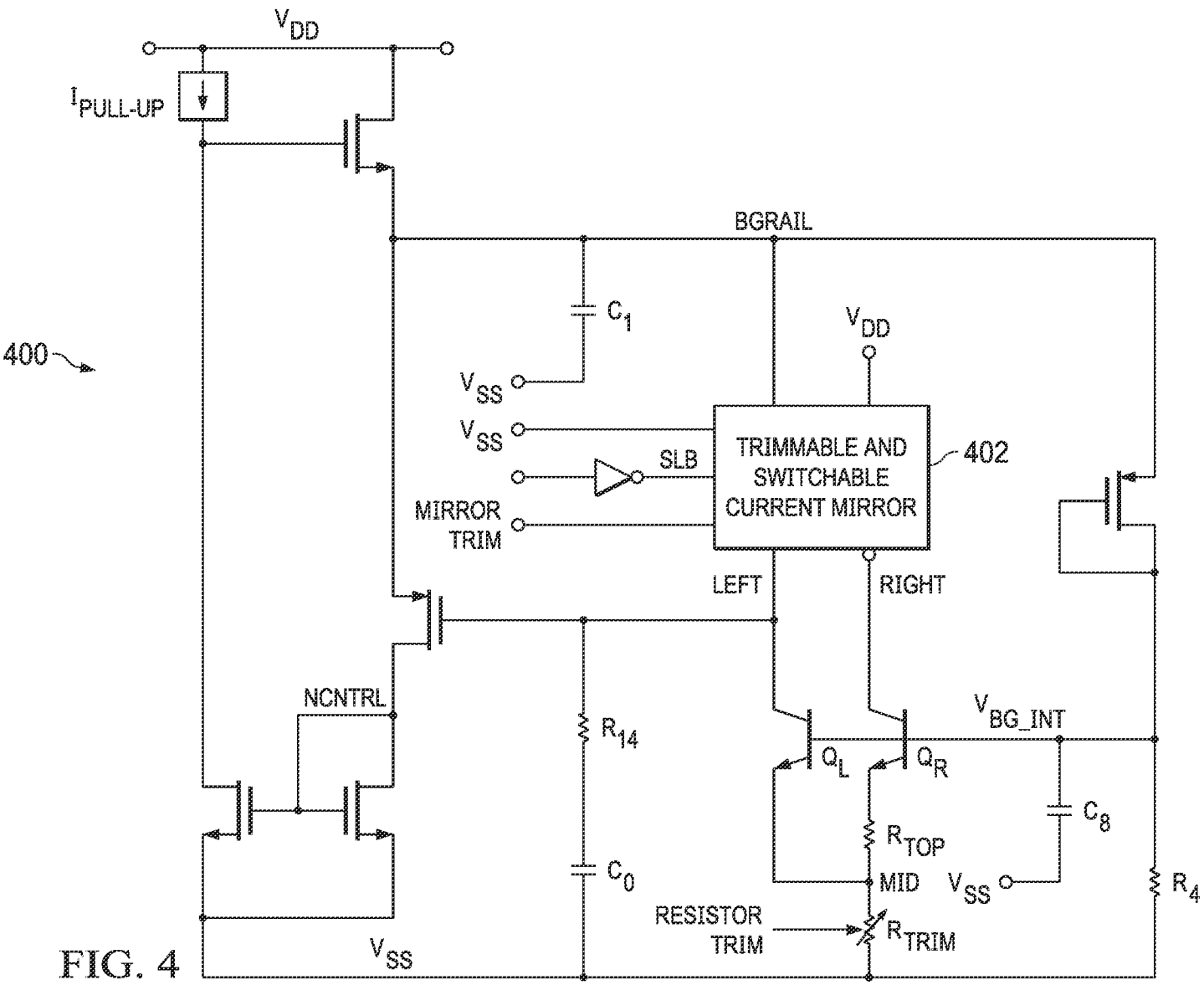
FIG. 4 is a block-level schematic of an example shunt bandgap reference.

FIG. 4 is a block-level schematic of an example shunt bandgap reference 400. Trimmable and switchable current mirror 402 in FIG. 4 can be implemented using the example switchable current mirror 200 of FIG. 2 or the example switchable current mirror 300 of FIG. 3. Inputs to current mirror 402 include mirror switch signal SLB and a mirror trim signal that can, for example, correspond to mirror trim bits T_BM<3:0> shown in FIG. 3. Trimmable resistor $R_{TRIM}$ can correspond in general function to resistor $R_{TRIM}$ in FIG. 1 and can be adjusted using a resistor trim signal, which, like the mirror trim signal, can comprise a number of bits. Positive rail $V_{DD}$ and shunt rail BGRAIL are shown near the top of FIG. 4. Shunt control signal NCNTRL, shown near the left side of FIG. 4, provides part of the feedback loop to left side of current mirror, labeled LEFT.

The objective in the example of FIG. 4, as in the example of FIG. 1, is to trim the current mirror 402 to minimize the current difference between the right and left terminals. As an example, there may be only about 100 nA flowing through each of the left and right terminals LEFT and RIGHT, and only about 50 nA of current may be flowing through shunt control NCNTRL. The bandgap reference as a whole, including these currents and others, may in some examples be limited to a current budget of only about 500 nA total. Under such a low $I_Q$ conditions, it may be difficult to precisely trim the current mirror 402 absent the switchable functionality provided by switchable current mirror 402 and as shown in greater detail in FIGS. 2 and 3.

Figure 5:
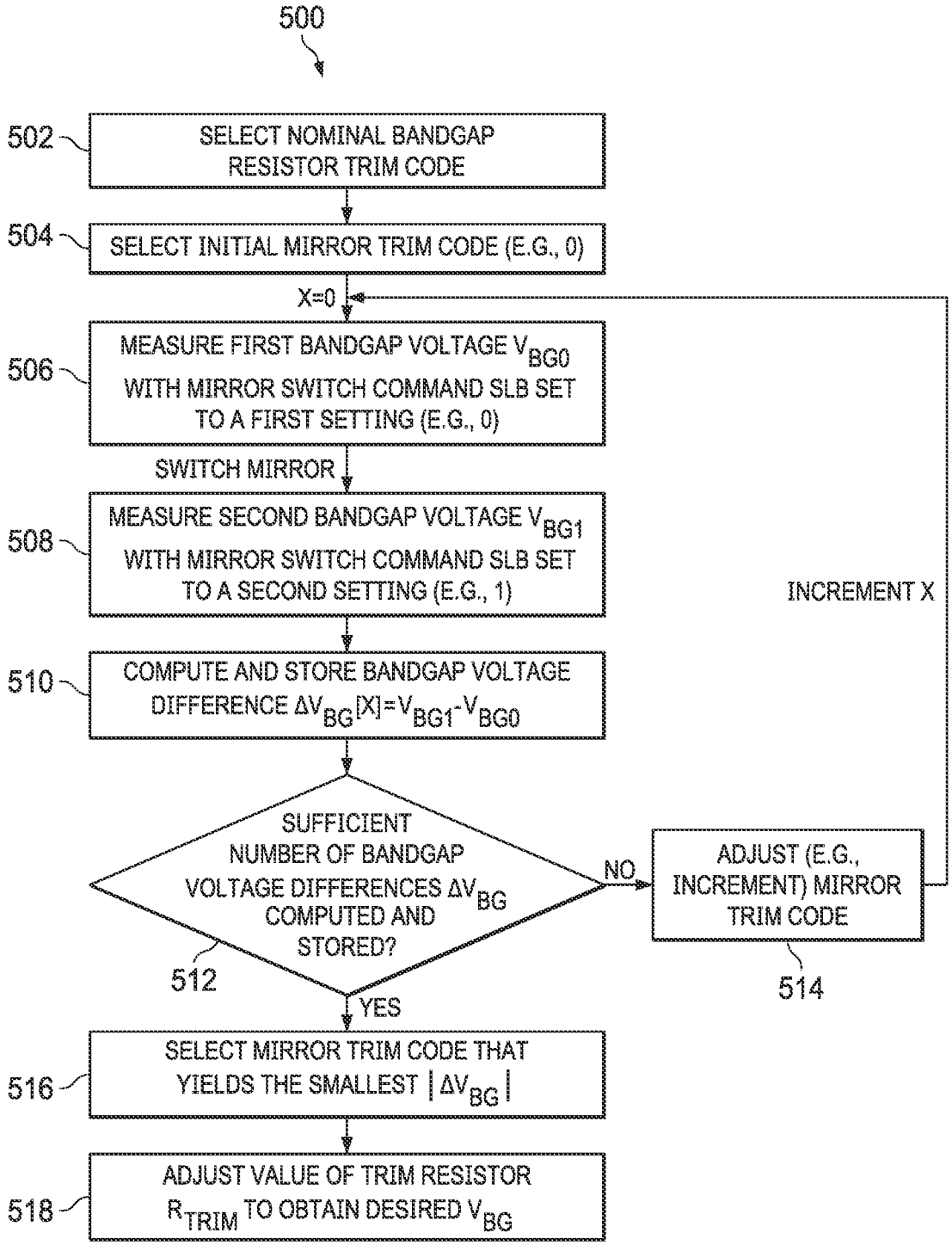
FIG. 5 is a flow chart of an example method of calibrating a bandgap reference.

FIG. 5 illustrates a method of calibrating a bandgap reference, including a method of trimming for low-$I_Q$ current mirrors that can be used in either of the example circuits 100 or 400, or any other type of circuit for which it is desired to trim a current source, and/or for which access to measurement the current from the current source is unavailable, impracticable, or would be too imprecise to accurately trim the current mirror. A nominal bandgap resistor trim code is selected 502. This nominal resistor trim code can be, for example, one that produces a resistance value of an adjustable bandgap trim resistor (e.g., resistor $R_{TRIM}$ in FIG. 1) that produces or that is expected to produce a bandgap voltage $V_{BG}$ closest to the desired bandgap voltage value, before any trimming of the current mirror, e.g., mirror 104 in FIG. 1. An initial mirror trim code (e.g., 0 for all mirror bits, 1 for all mirror bits, or at some intermediate value) is selected 504. A first bandgap voltage $V_{BG0}$ is measured 506 with the mirror switch command (SLB in the above-described examples) set to a first setting (e.g., logical "0"). The current mirror is then switched, e.g., by switching current mirror 204 to flip the value of signal SLB. In the example of FIG. 2, then, the left transistor 206 is thereby connected to the left terminal 214 and the right transistor 208 is connected to the right terminal 216, or vice-versa, depending on the starting value of SLB ("0" or "1"). A second bandgap voltage $V_{BG1}$ is then measured 508 with the mirror switch command set to a second setting (e.g., logical "1").

The difference between the second and first measured bandgap voltages is then computed and stored 510, providing $\Delta V_{BG}[X]=V_{BG1}-V_{BG0}$ for an initial iteration value X (e.g., 0). This measurement can be done, for example, by closing switch 112 in FIG. 1 to connect bandgap voltage measurement, storage, and comparison circuitry 114 in FIG. 1 to the bandgap voltage terminal $V_{BG}$. In different examples, circuitry 114 can take for form of a microprocessor, a digital signal processor (DSP), or other digital logic, and can include registers for storage of bandgap voltage measurements and difference computations, as well as a subtractor to calculate bandgap voltage differences. In some examples, circuitries 108, 110, 116, and/or 106 can also share the same digital logic resources as circuitry 114.

The measuring 508, measuring 510, and computing and storing the difference is then iteratively repeated for different mirror trim codes, either until all mirror trim codes have been exhaustively tried, or until the absolute value of the difference in measured bandgap voltages $|\Delta V_{BG}|$ between switches of the current mirror has been minimized with a less exhaustive method.

If a sufficient number of bandgap voltage differences $\Delta V_{BG}$ have been computed and stored to ensure that the minimum absolute value bandgap voltage difference min ($|\Delta V_{BG}||$) has been attained 512, then the mirror trim code that yields the smallest absolute value bandgap voltage difference min($|\Delta V_{BG}$) can be selected 516. Otherwise, the mirror trim code can be adjusted 514 (e.g., by current mirror trim controller circuitry 108) and, with iteration number X incremented, the measuring 506 of the bandgap voltage, the switching of the switchable mirror, the measuring 508 of the bandgap voltage again, and the computing and storing 510 of the difference between the two measured bandgap voltages is repeated. In some examples, the adjustment 514 can be a simple incrementation of the mirror trim code, or decrementation if the process began with the maximum mirror trim code value, and all mirror trim codes can be tried before the iterative loop terminates 516, such that there is a recorded $|\Delta V_{BG}|$ for each mirror trim code, making for 16 iterations in examples with a four-bit mirror trim code. In other examples, the adjustment 514 can be adapted to home in on the minimized $|\Delta V_{BG}|$ with a reduced number of iterations.

In some examples, after the optimal mirror trim code is selected 516, the method 500 can further continue by trimming the bandgap resistor $R_{TRIM}$ to set the bandgap voltage $V_{BG}$ to a desired value. Thus, although the process 500 may have begun 502 with an arbitrarily selected nominal bandgap resistor trim code, an improved value of this resistor trim code may be determined following current mirror trimming.

Figure 6:
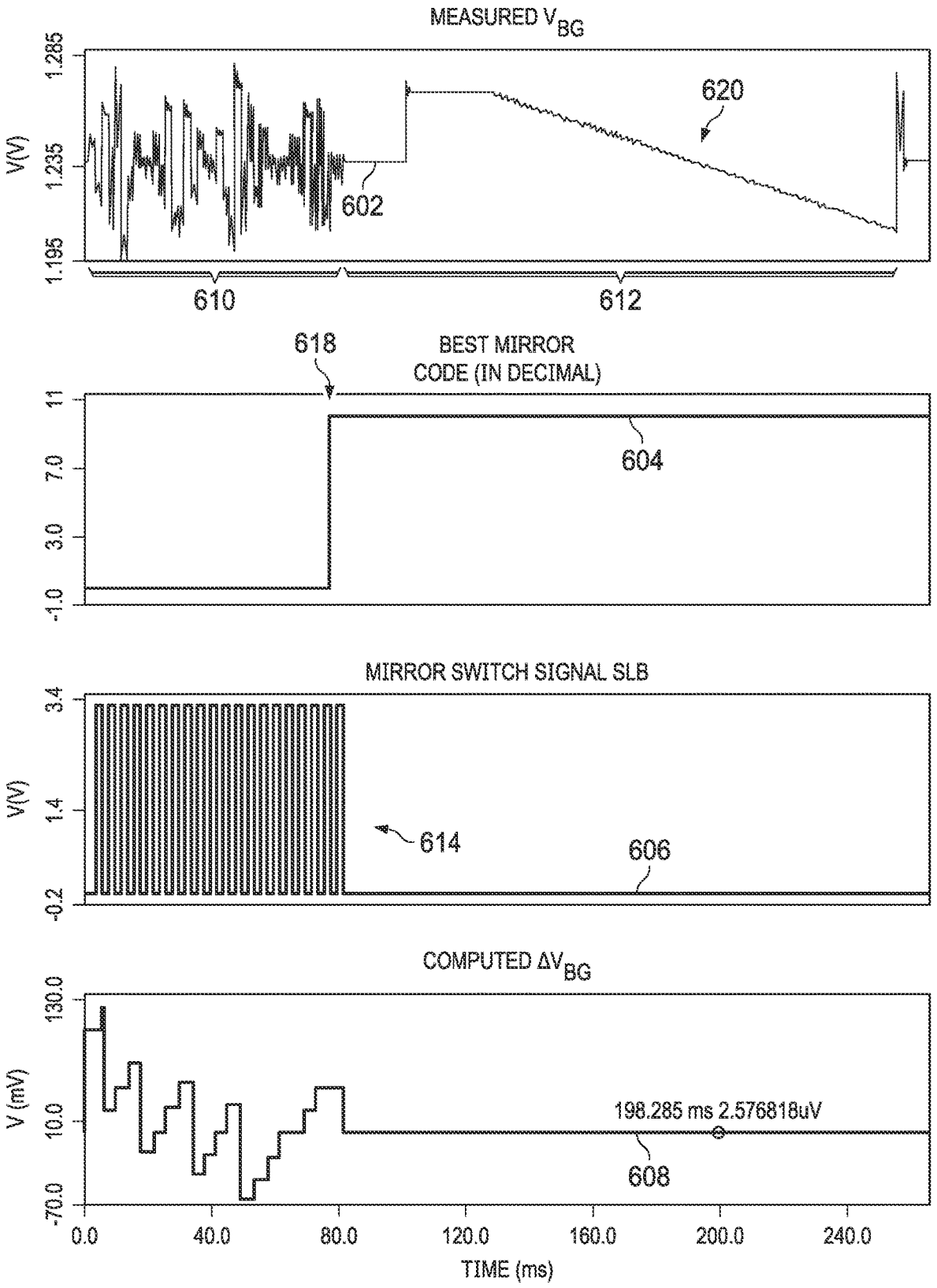
FIG. 6 is a trim timing diagram showing an example trimming.

The trim timing diagram of FIG. 6 provides a waveform graph of an example execution of the process 500 of FIG. 5. A first plot 602 illustrates the bandgap voltage as may be measured at an output, such as at terminal $V_{BG}$ in FIG. 1. A second plot 604 is indicative of a determined optimal mirror trim code. A third plot 606 represents the current mirror switch signal SLB. A fourth plot 608 shows the computed difference in measured bandgap voltages between different switches of the current mirror. During a mirror trimming phase 610 of the process, various trim codes are incrementally tried 616 while the mirror switching signal switches back and forth 614 between each mirror trim code adjustment. In the illustrated example, some mirror trim codes may be repeated more than once. Once all mirror trim codes have been tried, the optimal mirror trim code is determined by determining the mirror trim code associated with the minimum recorded value of the absolute value of the difference between measured bandgap voltages with different switches of the current mirror, and the best mirror code signal 604 is thereupon set 618 to a value representative of the determined optimal mirror trim code. During a bandgap resistor trimming phase 612 of the process, after the current mirror has been trimmed 618, various values of the bandgap resistor may be tried, either by testing 620 all resistor trim codes exhaustively, as illustrated, or by a less exhaustive method that can home in on an optimal resistor trim code. With the resistor trim code having been set to its new value, the bandgap voltage 602 stands at the desired value.

The systems and methods of this description provide indirect measurement and trimming of a current mirror, and can be used to trim bandgap voltage source circuits or other types of circuits that use current mirrors. When used to trim bandgap voltage source circuits, the systems and methods of this description provide enhanced precision for beyond what would normally be available for calibration of the bandgap voltage. The systems and methods of this description permit a bandgap voltage source to be trimmed to provide a desired voltage value without measuring the quiescent current $I_Q$ of the bandgap voltage source circuit. Trimming of the bandgap voltage source is thereby permitted when such a current is too small for practical measurement during trimming or when such measurement is impractical or undesirable because of any effects the connection of measurement equipment may have on the rest of the circuit. The methods and systems of this description thus present a practical way to trim current mirrors without measuring the current directly and thus subjecting the trimming to current measurement errors due to leakage or resolution limitations.

The systems and methods of this description can also be applied to other devices, any time access to a mirrored current is unavailable, beneath measurement resource precision, or in cases that direct measurement of the current would be undesirable because of the effect on the current that would be incurred by connection of other circuits to the current. The systems and methods of this description may be particularly useful in low-$I_Q$ devices, such as devices that are provided power by a battery, including low-dropout regulators (LDOs), high-voltage-to-low-voltage switchers, low-voltage-to-high-voltage switchers, and controllers. As an example, the systems and methods of this description can be used in automotive applications, e.g., in systems that provide electrical power to onboard devices, including vehicle-mounted video cameras and mobile device chargers.

In this description, the term "based on" means based at least in part on. Also, in this description, the term "couple" or "couples" means either an indirect or direct wired or wireless connection. Thus, if a first device, element, or component couples to a second device, element, or component, that coupling may be through a direct coupling or through an indirect coupling via other devices, elements, or components and connections. Similarly, a device, element, or component that is coupled between a first component or location and a second component or location may be through a direct connection or through an indirect connection via other devices, elements, or components and/or couplings. A device that is "configured to" perform a task or function may be configured (e.g., programmed and/or hardwired) at a time of manufacturing by a manufacturer to perform the function and/or may be configurable (or re-configurable) by a user after manufacturing to perform the function and/or other additional or alternative functions. The configuring may be through firmware and/or software programming of the device, through a construction and/or layout of hardware components and interconnections of the device, or a combination thereof. Furthermore, a circuit or device that is described herein as including certain components may instead be configured to couple to those components to form the described circuitry or device. For example, a structure described as including one or more semiconductor elements (such as transistors), one or more passive elements (such as resistors, capacitors, and/or inductors), and/or one or more sources (such as voltage and/or current sources) may instead include only the semiconductor elements within a single physical device (e.g., a semiconductor die and/or IC package) and may be configured to couple to at least some of the passive elements and/or the sources to form the described structure either at a time of manufacture or after a time of manufacture, such as by an end-user and/or a third-party.

Modifications are possible in the described embodiments, and other embodiments are possible, within the scope of the claims.

What is claimed is:

1. A trimmable and switchable current mirror comprising:

a first terminal configured to provide a reference current to be mirrored;

a second terminal configured to provide an output current that mirrors the reference current;

a first trimmable transistor and a second trimmable transistor each having a respective gate, source, and drain and coupled to each other at their respective gates, and to a positive voltage terminal at their respective sources;

a first switch coupled at a first end to the drain of the first trimmable transistor and at a second end to the gate of the first trimmable transistor, the first switch being controlled by a mirror switch signal;

a second switch coupled at a first end to the drain of the second trimmable transistor and at a second end to the gate of the second trimmable transistor, the second switch being controlled by a logical complement of the mirror switch signal;

a first multiplexer coupled at an input terminal of the first multiplexer to the drain of the first trimmable transistor, at a first selectable output terminal of the first multiplexer to the second terminal of the current mirror, and at a second selectable output terminal of the first multiplexer to the first terminal of the current mirror, a selection between the first and second selectable output terminals of the first multiplexer being controlled by the mirror switch signal;

a second multiplexer coupled at an input terminal of the second multiplexer to the drain of the second trimmable transistor, at a first selectable output terminal of the second multiplexer to the second terminal of the current mirror, and at a second selectable output terminal of the second multiplexer to the first terminal of the current mirror, a selection between the first and second selectable output terminals of the second multiplexer being controlled by the logical complement of the mirror switch signal;

a mirror switch input configured to provide the mirror switch signal; and a mirror trim input configured to provide mirror trim signals to the first and second trimmable transistors.

2. The current mirror of claim 1, wherein each of the first and second trimmable transistors comprises field effect transistors (FETs), respective gates of some of the FETs being coupled to bit lines of the mirror trim input, each of the first and second trimmable transistors being configured to have their respective width-to-length ratios effectively adjusted with control of binary signals provided on the bit lines.

3. The current mirror of claim 2, wherein the mirror trim signals consist of a four-bit mirror trim code.

4. A bandgap voltage reference comprising the current mirror of claim 1, and further comprising:

a first bipolar junction transistor (BJT) and a second BJT each having a respective base, emitter, and collector and coupled to each other at their respective bases, the collector of the second BJT being coupled to the second terminal of the current mirror and the collector of the first BJT being coupled to the first terminal of the current mirror, the first BJT being larger in area than the second BJT;

a first resistor coupled at a first end to the emitter of the first BJT and at a second end to the emitter of the second BJT;

a trimmable second resistor coupled at a first end to the emitter of the second BJT and at a second end to a low voltage terminal; and a bandgap control feedback loop coupled at a first end to the bases of the second and first BJTs and at a second end to the second terminal of the current mirror.

5. The voltage reference of claim 4, further comprising current mirror trim controller circuitry having an output coupled to the mirror trim input of the current mirror and configured to provide mirror trim bits to the current mirror.

6. The voltage reference of claim 5, further comprising current mirror switch controller circuitry having an output coupled to the mirror switch input of the current mirror and configured to provide the mirror switch signal to the current mirror.

7. The voltage reference of claim 6, further comprising bandgap voltage measurement, storage, and comparison circuitry having an input coupled to the bases of the first and second BJTs and configured to:

measure, at respective first and second times, first and second bandgap voltages at the bases for respective high and low values of the mirror switch signal;

store a difference value of a difference between the first and second bandgap voltages;

repeat the measurement of the first and second bandgap voltages and the storage of the difference value for different values of the mirror trim bits; and select as a mirror trim code the value of the mirror trim bits that results in the lowest absolute value of the difference value.

8. The voltage reference of claim 7, further comprising a bandgap voltage connection switch coupled at a first end to the connected bases of the first and second BJTs and at a second end to the bandgap voltage measurement, storage, and comparison circuitry.

9. The voltage reference of claim 7, further comprising bandgap resistor trim controller circuitry having an output coupled to the input of the trimmable second resistor and configured to adjust a resistance value of the trimmable second resistor to a nominal trim resistance value prior to the measurement of the first and second bandgap voltages; and to a final trim resistance value after the selection of the mirror trim code.

10. The voltage reference of claim 4, wherein the bandgap control feedback loop further comprises bandgap control loop circuitry.

11. The voltage reference of claim 4, wherein the voltage reference is configured as a Brokaw cell.

12. The voltage reference of claim 4, wherein the voltage reference is configured as a shunt.

13. A method of trimming a current mirror in a bandgap voltage reference, the method comprising:

selecting an initial mirror trim code, the mirror trim code adjusting the effective width-to-length ratios of first and second transistors in the current mirror, the first and the second transistor being alternately selectable as a diode-connected transistor within the current mirror via a mirror switch command;

for different mirror trim codes, beginning with the initial mirror trim code, storing a number of bandgap voltage differences by:

measuring a first bandgap voltage with the mirror switch command set to a first setting;

measuring a second bandgap voltage with the mirror switch command set to a second setting; and computing and storing a difference between the second bandgap voltage and the first bandgap voltage;

selecting one of the mirror trim codes that results in a lowest absolute value difference from among the stored bandgap voltage differences; and trimming the current mirror with the selected mirror trim code.

14. The method of claim 13, further comprising, before the storing the number of bandgap voltage differences, trimming a bandgap resistor in the bandgap voltage reference with a selected nominal bandgap resistor trim code.

15. The method of claim 13, further comprising, after the storing the number of bandgap voltage differences:

determining a final bandgap resistor trim code by:

applying different bandgap resistor trim codes to a bandgap resistor in the bandgap voltage reference; and selecting a final bandgap resistor trim code from among the different bandgap resistor trim codes that results in a bandgap voltage closest to a desired bandgap voltage value; and trimming the bandgap resistor with the final bandgap resistor trim code.

16. A bandgap voltage reference comprising:

a trimmable and switchable current mirror having a first terminal configured to provide a reference current to be mirrored and a second terminal configured to provide an output current that mirrors the reference current, and having first and second transistors that are trimmable via a mirror trim signal and are alternately selectably diode-connected via a mirror switch signal;

a first bipolar junction transistor (BJT) and a second BJT each having a respective base, emitter, and collector and coupled to each other at their respective bases, the collector of the second BJT being coupled to the second terminal of the current mirror and the collector of the first BJT being coupled to the first terminal of the current mirror, the first BJT being larger in area than the second BJT;

a first resistor coupled at a first end to the emitter of the first BJT and at a second end to the emitter of the second BJT;

a trimmable second resistor coupled at a first end to the emitter of the second BJT and at a second end to a low voltage terminal; and a bandgap control feedback loop coupled at a first end to the bases of the first and second BJTs and at a second end to the second terminal of the current mirror.

17. The voltage reference of claim 16, further comprising current mirror trim controller circuitry having an output coupled to a mirror trim input of the current mirror and configured to provide the mirror trim signal to the current mirror.

18. The voltage reference of claim 17, further comprising current mirror switch controller circuitry having an output coupled to a mirror switch input of the current mirror and configured to provide the mirror switch signal to the current mirror.

19. The voltage reference of claim 18, further comprising bandgap voltage measurement, storage, and comparison circuitry having an input coupled to the bases of the first and second BJTs and configured to:

measure, at respective first and second times, first and second bandgap voltages at the bases for respective high and low values of the mirror switch signal;

store a difference value of a difference between the first and second bandgap voltages;

repeat the measurement of the first and second bandgap voltages and the storage of the difference value for different values of the mirror trim signal; and trim the current mirror with a selected mirror trim value of the mirror trim signal that results in a lowest absolute value of the difference value.

20. The voltage reference of claim 19, further comprising bandgap resistor trim controller circuitry having an output coupled to the input of the trimmable second resistor and configured to adjust the resistance value of the trimmable second resistor to a nominal trim resistance value prior to the measurement of the first and second bandgap voltages; and to a final trim resistance value after the trimming of the current mirror with the selected mirror trim value.

* * * * *